US006483396B1

(12) United States Patent
Kwon et al.

(10) Patent No.: US 6,483,396 B1
(45) Date of Patent: Nov. 19, 2002

(54) MICROWAVE SYSTEM WITH REDUNDANT PROCESSING DEVICES AND PASSIVE SWITCHING

(75) Inventors: Andrew H. Kwon, Thousand Oaks, CA (US); Hector J. De Los Santos, Inglewood, CA (US)

(73) Assignee: Hughes Electronics Corp., Los Angeles, CA (US)

( * ) Notice: Subject to any disclaimer, the term of this patent is extended or adjusted under 35 U.S.C. 154(b) by 0 days.

(21) Appl. No.: 09/552,955

(22) Filed: Apr. 20, 2000

(51) Int. Cl.[7] ..... H01P 1/10
(52) U.S. Cl. ..... 333/108; 333/113
(58) Field of Search ..... 333/108, 113, 333/114

(56) References Cited

U.S. PATENT DOCUMENTS

| | | | | |
|---|---|---|---|---|
| 3,286,202 A | * | 11/1966 | Daveau et al. | 333/108 |
| 3,721,921 A | * | 3/1973 | Lamy et al. | 333/10 |
| 6,069,529 A | * | 5/2000 | Evans | 330/124 |
| 6,081,170 A | * | 6/2000 | Enokuma | 333/134 |

FOREIGN PATENT DOCUMENTS

| | | | |
|---|---|---|---|
| GB | 1 507 147 | | 4/1978 |
| JP | 411168301 A | * | 6/1999 |

OTHER PUBLICATIONS

Simon Ramo et al., Fields and Waves in Communication Electronics, 1965, John Wiley & Sons, Inc., 2nd Ed. pp. 216–218.*

Kenney, Electronic Communication Systems, 1970, McGraw–Hill, Inc., 2nd Ed. pp. 365–366.*

Patent Abstracts of Japan, vol. 010, No. 168 (E–411) & JP 61 018204 A (Fujitsu Ltd), Jan. 27, 1986, abstract.

* cited by examiner

*Primary Examiner*—Robert Pascal
*Assistant Examiner*—Joseph Chang
(74) *Attorney, Agent, or Firm*—John R. Rafter; Terje Gudmestad

(57) ABSTRACT

A redundant microwave system operable to process a microwave signal propagating in a microwave cavity includes a microwave cavity and two microwave processing devices. Each microwave processing device has a transmissive impedance when it is on and a reflective impedance when it is off. There is a separate coupling probe extending from each of the microwave processing devices to locations within the microwave cavity. When a primary one of the microwave processing devices is switched on and the redundant microwave processing device is switched off, its coupling probe reflects energy so that almost all of the energy flows through the primary microwave processing device. If the primary microwave processing device fails and is switched off, its coupling probe reflects energy so that almost all energy flows through the redundant device. No separate active switching device or circuit is used.

20 Claims, 4 Drawing Sheets

MICROWAVE SYSTEM WITH REDUNDANT PROCESSING DEVICES AND PASSIVE SWITCHING

This invention relates to a microwave system which has redundant processing devices and, more particularly, to an approach for accomplishing switching between the processing devices when the primary device fails and the redundant device is activated.

BACKGROUND OF THE INVENTION

Microwave systems are sometimes used in situations where their operation is critical and cannot be interrupted, or where they are difficult to repair in the event of a failure. For example, microwave amplifier circuits used in communications satellites receive microwave communications signals transmitted from a ground station to the satellite, amplify those signals, and retransmit them back to another ground station. These circuits cannot be permitted to fail, both because their failure would render the entire communications channel useless and because it is difficult to repair the amplifier circuits. Similar considerations apply to microwave communications circuits in deep space and interplanetary missions.

To ensure continuous operation, most microwave systems used in such critical applications are furnished with redundant active components. For example, there may be a primary active amplifier and a backup active amplifier in each communications circuit. The primary active amplifier is used in normal operation, with the backup active amplifier switched off. If the primary active amplifier fails, the backup active amplifier is switched on.

The microwave signal propagating in a waveguide is switched from the primary active amplifier to the backup active amplifier. Available microwave waveguide switches are heavy, costly, complex to integrate into the microwave waveguide system, and consume power. In the case of electro-mechanical or ferrite waveguide switches, the bulkiness of the switch limits the degree of miniaturization that may be achieved. These considerations are particularly troublesome where there are multiple microwave waveguide switches required to interconnect various redundant active devices. Nevertheless, the risk in loss of the communications circuit has been judged to mandate the use of the redundant active components and the associated microwave switches.

There is a need for an improved approach to providing redundancy in microwave circuits that require such redundancy due to their critical nature or inaccessibility for repair. The present invention fulfills this need, and further provides related advantages.

SUMMARY OF THE INVENTION

The present invention provides a redundant microwave system wherein switching between a primary microwave processing device and a redundant backup microwave processing device is accomplished without the use of an active switch. The weight, cost, bulk, and possible signal loss of an active switch are saved, but advantages of redundancy are retained. The present approach may be implemented in a wide range of applications.

A redundant microwave system operable to process a microwave signal propagating in a microwave cavity comprises a microwave cavity and a first microwave processing device located exterior to the microwave cavity. The first microwave processing device has a transmissive impedance when the first microwave processing device is operable and a reflective impedance when the first microwave processing device is not operable. A first coupling probe extends from the first microwave processing device to a first probe termination location within an interior of the microwave cavity. A second, redundant, microwave processing device is located exterior to the microwave cavity. The second microwave processing device is substantially identical to the first microwave processing device and has the transmissive impedance when the second microwave processing device is operable and the reflective impedance when the second microwave processing device is not operable. A second coupling probe extends from the second microwave processing device to a second probe termination location within the interior of the microwave cavity. Either of the microwave processing devices may include an impedance-matching network.

The two microwave processing devices may be of any operable type, but are typically amplifiers or receivers. The coupling probes may be of any operable type, but are typically coaxial probes or stripline probes.

There are three particularly preferred embodiments of this approach, In one, the first probe termination location and the second probe termination location are each positioned at about a respective one of the two electric field spatial maxima of a TE(2,0) microwave signal propagating in the waveguide. In a practical implementation, the microwave cavity is a rectangular waveguide having a direction of elongation, a long transverse dimension perpendicular to the direction of elongation, a first sidewall parallel to the direction of elongation and perpendicular to the long transverse dimension, and a second sidewall parallel to the direction of elongation and perpendicular to the long transverse dimension. The first sidewall is spaced apart from the second sidewall by the long transverse dimension, The first probe termination location is about ¼ of the distance from the first sidewall to the second sidewall, and the second probe termination location is about ¾ of the distance from the first sidewall to the second sidewall.

In a second embodiment, the first probe termination location and the second probe termination location are each positioned at about the single electric field spatial maximum of a TE(1,0) microwave signal propagating in the waveguide, In a practical implementation, the microwave cavity is a rectangular waveguide having a direction of elongation, a long transverse dimension perpendicular to the direction of elongation, a first sidewall parallel to the direction of elongation and perpendicular to the long transverse dimension, and a second sidewall parallel to the direction of elongation and perpendicular to the long transverse dimension. The first sidewall is spaced apart from the second sidewall by the long transverse dimension. The first probe termination location and the second probe termination location are each about midway between the first sidewall and the second sidewall, positioned closely together and immediately adjacent to each other, but still distinctly two separate probes.

In a third embodiment, the microwave cavity comprises a first volume, a microwave feed in communication with the first volume, and a second volume communicating with the first volume. The second volume is separated into a first region and a second region by a wall. The first probe termination location is within the first region and the second probe termination is within the second region.

In the general approach and all of these specific embodiments, each of the microwave processing devices has two impedance states. When the microwave processing device is active (the "on" state), its transmissive impedance is such that the microwave signals pass between the microwave cavity and the active microwave processing device, through the coupling probe. That is, the transmissive impedance establishes boundary conditions within the cavity such that there is a mode conversion and propagation of the microwave signal into the coupling probe. When the microwave processing device becomes inactive (the "off" state), its reflective impedance is such that the microwave signals do not pass between the microwave cavity and the active microwave processing device, through the coupling probe. That is, the reflective impedance establishes boundary conditions within the cavity such that there is not a mode conversion and propagation of the microwave signal into the coupling probe. Operable values of transmissive and reflective impedances may be readily determined using conventional microwave techniques.

In service, the first microwave processing device is operated as the active primary processing device, and the other, second microwave processing device is inactive as the redundant microwave processing device. If the first microwave processing device fails or is otherwise removed from service, it is switched off so that its impedance results in rejection of the microwave energy. The redundant microwave processing device is switched on, so that it no longer rejects the microwave energy in the microwave cavity and allows it to flow to the second microwave processing device.

The present approach may be contrasted with the usual approach for accomplishing switching in redundant microwave circuits. In the conventional approach, in addition to the two microwave processing devices there is a separate device, an active waveguide switch, that directs microwave energy flowing in the waveguide either to the primary device or to the redundant device. In the present approach, there is a mode conversion between the microwave cavity and the two probes. The load impedances of the microwave processing devices themselves are used to alter the boundary conditions of the waveguide cavity and thence the input impedances of the mode conversions accomplished at the microwave cavity/probe interface, so that no separate active switch is required.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
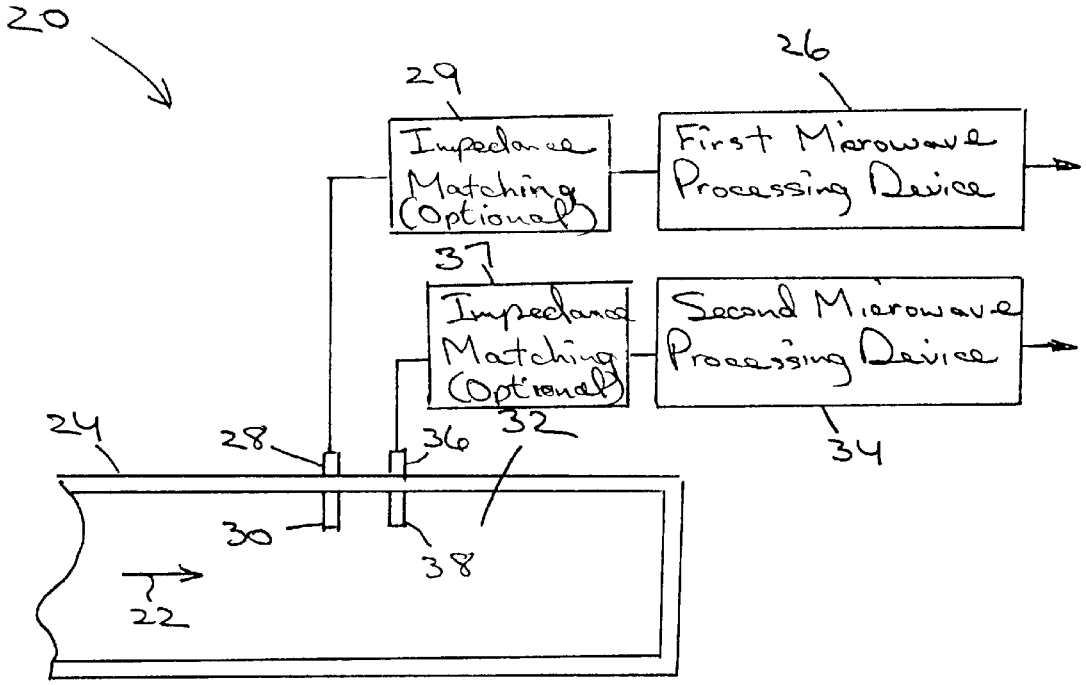
FIG. 1 is a general schematic view of a redundant microwave system.

FIG. 1 depicts a redundant microwave system 20 that is operable to process a microwave signal 22. The microwave system 20 includes a microwave cavity 24, which in some specific embodiments to be discussed subsequently is a waveguide and in other embodiments is a cavity. A first microwave processing device 26 is located exterior to the microwave cavity 24. The first microwave processing device 26 may be of any operable type, but is typically an amplifier such as a low noise amplifier, a solid state power amplifier, or a traveling wave tube amplifier, or a receiver such as a low noise receiver. The first microwave processing device 26 is characterized by and has a transmissive impedance when the first microwave processing device is operable (i.e., in an "on" state) and a reflective impedance when the first microwave processing device is not operable (i.e., in an "off" state).

A first coupling probe 28 extends from the first microwave processing device 26 to a first probe termination location 30 within an interior 32 of the microwave cavity 24. The first coupling probe 28 may be of any operable type, with a coaxial-construction probe or a stripline-construction probe favored. An impedance matching network 29 is optionally present in the line between the first microwave processing device 26 and the first coupling probe 28. In most cases, the impedance-matching network 29 is present, but in some instances it may be omitted if the impedances of the microwave processing device and the microwave cavity are naturally matched. It is therefore "optional", but usually present. Where an impedance-matching network is present, it may be considered as part of the microwave processing device.

A second microwave processing device 34 is located exterior to the microwave cavity 24. The second microwave processing device 34 is substantially identical to the first microwave processing device 26. The first microwave processing device 26 may be thought of as the primary active device, and the second microwave processing device 34 may be thought of as the redundant active device. The second microwave processing device 34, like the first microwave processing device 26, has the transmissive impedance when the second microwave processing device 34 is operable (i.e., in an "on state) and the reflective impedance when the second microwave processing device 34 is not operable (i.e., in an "off" state).

A second coupling probe 36 extends from the second microwave processing device 34 to a second probe termination location 38 within the interior 32 of the microwave cavity 24. The second coupling probe 36 may be of any operable type, with a coaxial-construction probe or a stripline-construction probe favored. An impedance matching network 37 is optionally present in the line between the second microwave processing device 34 and the second coupling probe 36. In most cases, the impedance-matching network 37 is present, but in some instances it may be omitted if the impedances of the microwave processing device and the microwave cavity are naturally matched. It is therefore "optional", but usually present.

The positions of the first probe termination location 30 and the second probe termination location 38 are indicated schematically in FIG. 1. Their exact positions for various embodiments will be discussed subsequently. In each case, there are two distinct probes and two distinct termination locations (even though they may be closely spaced in some cases).

Figure 2:
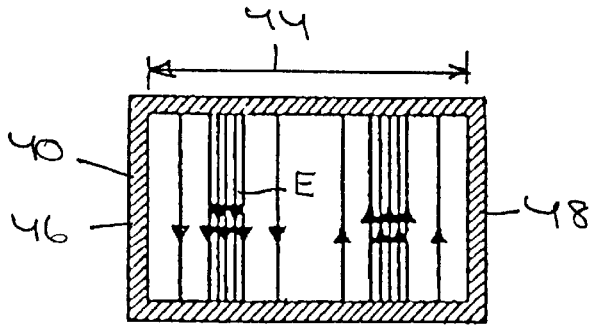
FIG. 2 is an illustration of the electric fields in the TE(2,0) mode of a rectangular waveguide.
Figure 3:
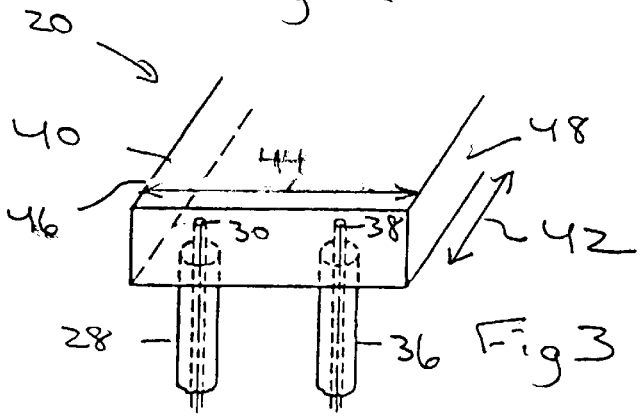
FIG. 3 is a schematic perspective view of two coupling probes interconnecting with a rectangular waveguide carrying microwave energy in the TE(2,0) mode.
Figure 4:
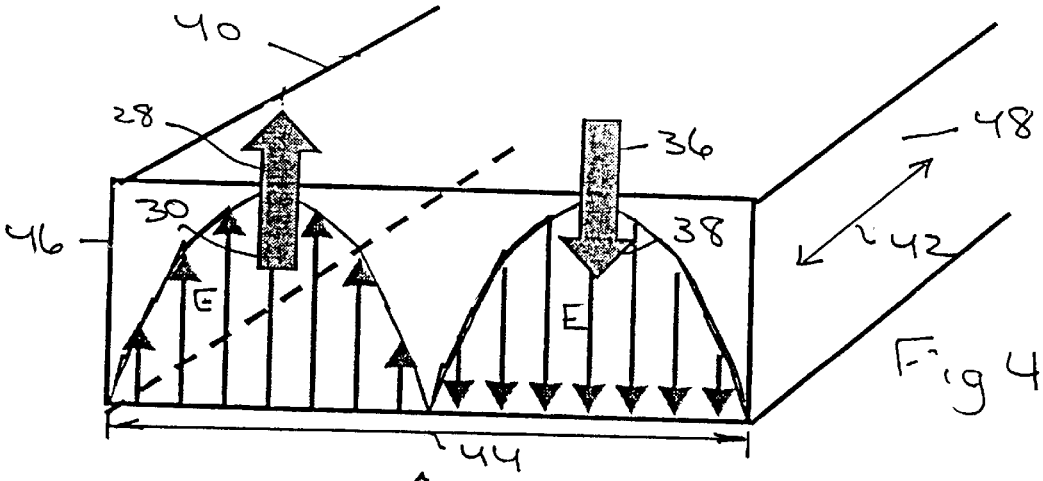
FIG. 4 is a schematic perspective view of the coupling probes of FIG. 3 and their spatial relation with the electric field vector in the rectangular waveguide carrying microwave energy in the TE(2,0) mode.

FIGS. 2–5 illustrate details of a first preferred embodiment of the approach of the invention, wherein the microwave cavity 24 is a waveguide 40 and the microwave signal propagates through the waveguide 40 in the TE(2,0) mode. FIG. 2 illustrates the electric field vector E in such a waveguide 40 with the microwave energy propagating in the TE(2,0) mode. There are two maxima in the E-field, at intermediate locations along the transverse width of the waveguide 40. As shown in FIGS. 3 and 4, the two coupling probes 28 and 36 are positioned at about these maxima in the E-field. Stated another way, the microwave cavity 24 is a rectangular waveguide 40 having a direction of elongation 42, a long transverse dimension 44 perpendicular to the direction of elongation 42, a first sidewall 46 parallel to the direction of elongation 42 and perpendicular to the long transverse dimension 44, and a second sidewall 48 parallel to the direction of elongation 42 and perpendicular to the long transverse dimension 44. The first sidewall 46 is spaced apart from the second sidewall 48 by the long transverse dimension 44. The first probe termination location 30 is about ¼ of the distance from the first sidewall 46 to the second sidewall 48 and the second probe termination location 38 is about ¾ of the distance from the first sidewall 46 to the second sidewall 48, the distances being measured parallel to the long transverse dimension 44.

Figure 5:
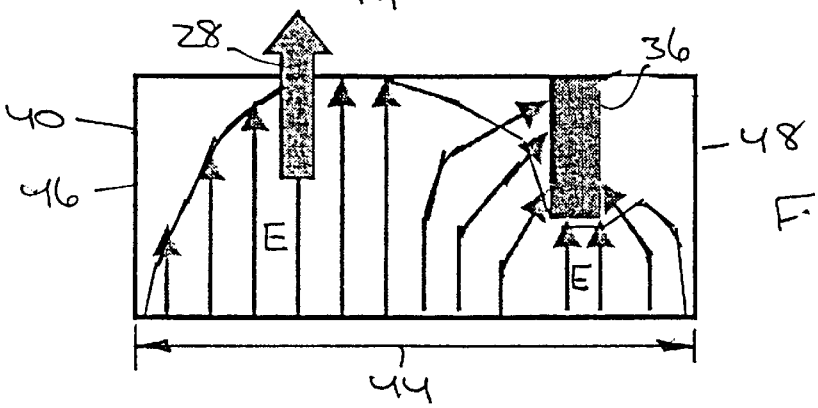
FIG. 5 is a schematic sectional view of the coupling probes of FIG. 3 and their interaction with the electric field vector in the rectangular waveguide carrying microwave energy in the TE(2,0) mode to produce a quasi-TE(2,0) mode.

FIG. 5 illustrates the result of having the first microwave processing device 26 operating and the second microwave processing device 34 not operating, The transmissive impedance of the first coupling probe 28 is such that microwave energy flows from the waveguide 40 into the first coupling probe 28. The reflective impedance of the second coupling probe 28 is such that it reflects microwave energy and does not transmit microwave energy to the second microwave processing device 34 The E-field is distorted as illustrated in FIG. 5, becoming a quasi-TE(2,0) mode with some resemblance to the TE(2,0) E-field of FIG. 2, but also with a substantial distortion. However, the flow of microwave energy into the first coupling probe 28 may be optimized using conventional microwave design techniques. The relations are reversed when the fist microwave processing device 28 is not operating and the second microwave processing device 34 is operating, which condition would occur if the first (primary) microwave device 28 bad failed and the second (redundant) microwave device 34 were switched on to replace it.

Figure 6:
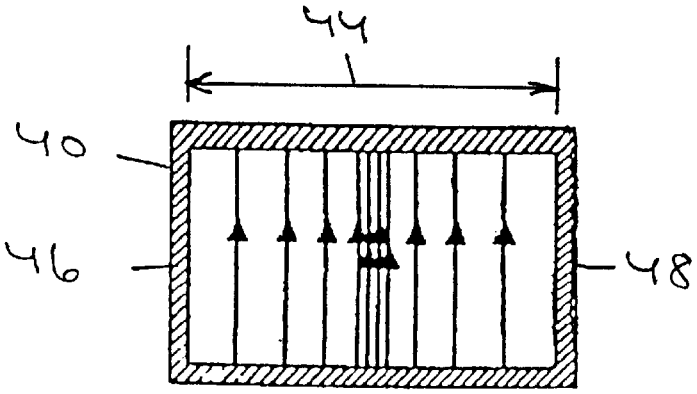
FIG. 6 is an illustration of the electric fields in the TE(1,0) mode of a rectangular waveguide.
Figure 7:
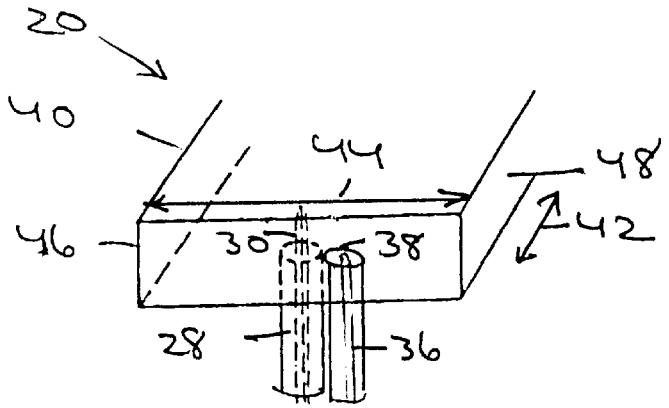
FIG. 7 is a schematic perspective view of two coupling probes interconnecting with a rectangular waveguide carrying microwave energy in the TE(1,0) mode.
Figure 8:
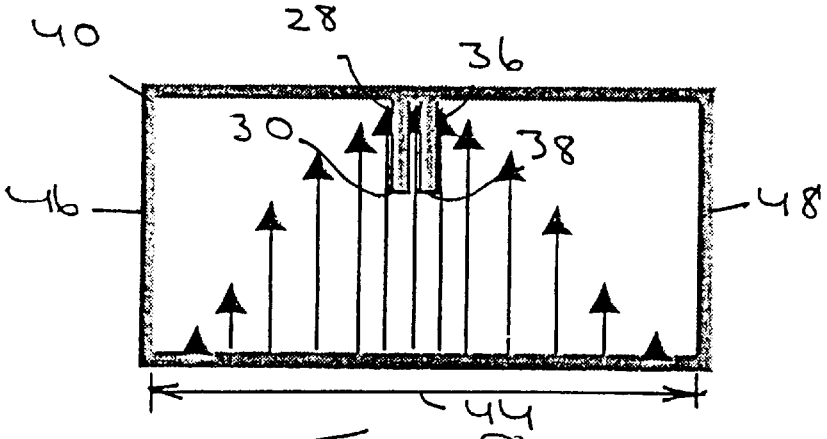
FIG. 8 is a schematic perspective view of the coupling probes of FIG. 3 and their spatial relation with the electric field vector in the rectangular waveguide carrying microwave energy in the TE(2,0) mode.

FIGS. 6–8 illustrate details of a second preferred embodiment of the approach of the invention, wherein the microwave cavity 24 is a waveguide 40 and the microwave signal propagates through the waveguide 40 in the TE(1,0) mode. (Because the terminology and features of the waveguide are similar to those of the first embodiment of FIGS. 2–5, the same nomenclature is used for the second embodiment where appropriate.) FIG. 6 illustrates the electric field vector E in such a waveguide 40 with the microwave energy propagating in the TE(1,0) mode. There is one maximum in the E-field, at the central location along the transverse width of the waveguide 40. As shown in FIGS. 7–8, the two coupling probes 28 and 36 are positioned closely together at about the position of the maximum in the E-field. Stated another way, the microwave cavity 24 is the rectangular waveguide 40 having the direction of elongation 42, the long transverse dimension 44 perpendicular to the direction of elongation 42, the first sidewall 46 parallel to the direction of elongation 42 and perpendicular to the long transverse dimension 44, and the second sidewall 48 parallel to the direction of elongation 42 and perpendicular to the long transverse dimension 44. The first sidewall 46 is spaced apart from the second sidewall 48 by the long transverse dimension 44. The first probe termination location 30 and the second probe termination location 38 are each about midway between the first sidewall 46 and the second sidewall 48. This positioning may be accomplished by placing the two coupling probes 28 and 36 directly next to each other at about the mid-point between the sidewalls 46 and 48 (as illustrated), or placing the two probes at the mid-point but one behind the other along the direction of elongation 42.

When the first microwave processing device 26 is operating and the second microwave processing device 34 is not operating, the transmissive impedance of the first coupling probe 28 is such that microwave energy flows from the waveguide 40 into the first coupling probe 28. The reflective impedance of the second coupling probe 28 is such that it reflects microwave energy and does not transmit microwave energy to the second microwave processing device 34. The relations are reversed when the first microwave processing device 28 is not operating and the second microwave processing device 34 is operating, which condition would occur if the first (primary) microwave device 28 had failed and the second (redundant) microwave device 34 were switched on to replace it.

The first and second embodiments utilize tie microwave waveguide 40, with the first coupling probe 28 located at a first electric field spatial maximum location and the second coupling probe 36 located at a second electric field spatial maximum location. The first electric-field spatial maximum location is the same as the second electric-field spatial maximum location if there is exactly one electric-field spatial maximum location, as in the case of the TE(1,0) mode propagation. The first electric-field spatial maximum location is different from and spaced apart from the second electric-field spatial maximum location if there is more than one electric-field spatial maximum location, as in the case of the TE(2,0) mode propagation.

Figure 9:
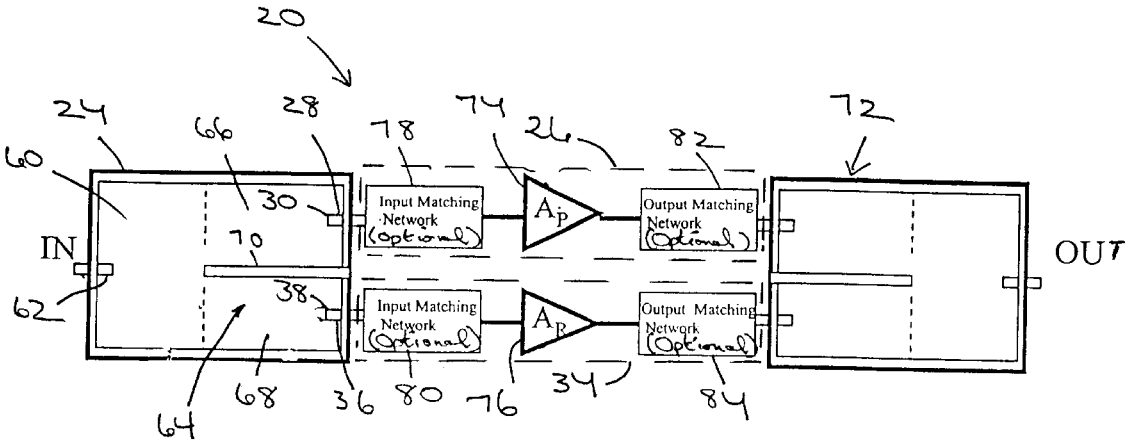
FIG. 9 is a schematic view of a cavity-coupled redundancy approach.

FIG. 9 illustrates aspects of a third preferred embodiment of the approach of the invention. The microwave cavity 24 includes a first volume 60, and a microwave feed 62 in communication with the first volume 60. The microwave cavity 24 further includes a second volume 64 communicating with the first volume 60. The second volume 64 is separated into a first region 66 and a second region 68 by a wall 70. The first probe termination location 30 is within the first region 66 and the second probe termination location 38 is within the second region 68. A similar arrangement may be used at the output end 72 of the redundant microwave system 20.

The third preferred embodiment of FIG. 9 includes the first microwave processing device 26 and the second microwave processing device 34. These devices 26 and 34 include active microwave components, such as illustrated a first microwave amplifier 74 and a second microwave amplifier 76. They may also, and usually do, include a first input impedance matching network 78 in series between the first coupling probe 28 and the first microwave amplifier 74, and a second input impedance matching network 80 in series between the second coupling probe 36 and the second microwave amplifier 76. They may also, and usually do, include a first output impedance matching network 82 in series between the output end 72 and the first microwave amplifier 74, and a second output impedance matching network 84 in series between the output end 72 and the second microwave amplifier 76. The impedance matching networks 78, 80, 82, and 84 are usually present but in some instances may be omitted if the impedances of the connected elements are naturally matched. They are therefore "optional", but usually present.

The impedance matching networks 78 and 80 transform the load impedance of the respective microwave amplifiers 74 and 76 into input impedances at the coupling probes 28 and 36 that either transmit (when the respective amplifier is "on") or reflect (when the respective amplifier is "off) the microwave energy in the microwave cavity 24. In an example, an input impedance of about 50 ohms at the coupling probe may allow microwave energy to pass from the cavity into the coupling probe, the amplifier, and other components, and to the output end. Any substantially greater or lesser input impedance reflects the microwave energy in the microwave cavity 24 and does not allow it to pass. Thus, when the first microwave amplifier 74 is turned on and the second microwave amplifier 76 is turned off, the first impedance matching network 78 sets the input impedance at the first coupling probe 28 to about 50 ohms and the second impedance matching network 80 sets the input impedance at the second coupling probe 36 to be some value substantially larger or smaller than about 50 ohms. Microwave energy flows through the first microwave processing device 26 but not through the second microwave processing device 34. At a later time, when the first microwave amplifier 74 is turned off (as in the case where it has failed) and the second microwave amplifier 76 is turned on (to serve as the redundant backup processing device), the first impedance matching network 78 sets the input impedance at the first coupling probe 28 to some value substantially larger or smaller than about 50 ohms and the second impedance matching network 80 sets the input impedance at the second coupling probe 36 to be about 50 ohms. Microwave energy flows through the second microwave processing device 34 but not through the first microwave processing device 26. The impedance matching networks 78 and 80 may be conventional structures such as a transmission line with the required impedance, a quarter wavelength transformer, or a shunt-mounted PIN diode. Similar principles apply for the design of impedance-matching networks for other embodiments as well, such as those of FIGS. 1, 2–5, and 6–8.

Figure 10:
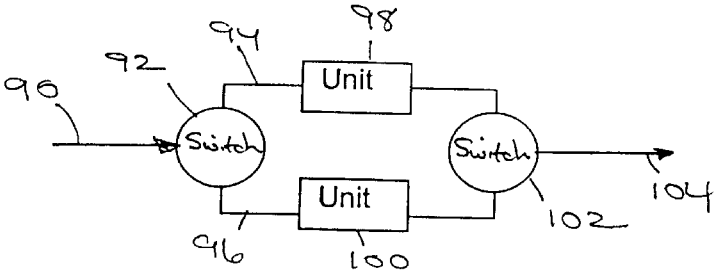
FIG. 10 is a schematic view of a conventional approach to microwave redundancy.

The present approach, shown generally in FIG. 1 and specifically in FIGS. 2–5, 6–8, and 9, is contrasted with a conventional approach as shown in FIG. 10. In the conventional approach, an input waveguide 90 provides energy to an input microwave waveguide switch 92. The input microwave waveguide switch 92 alternatively directs the energy in the input waveguide 90 into a first waveguide 94 or a second waveguide 96, which conduct the energy to the respective first device 98 or second device 100. The outputs of the devices 98 and 100 are provided to an output microwave waveguide switch 102, and thrice to an output waveguide 104. This conventional approach is operable, but it requires the two microwave waveguide switches 92 and 102, with their associated weight, size, cost, attenuation of signal strength, and potential for failure. The present approach avoids these problems.

The present approach of switching microwaves in cavities is also contrasted with the switching of signals in circuits in which the signals propagate on wires, either in the microwave range or at lower frequencies. Where the signal propagates on a wire, switching is accomplished by redirection of electron flow. In the case where the signals propagate in a waveguide cavity, the switching is accomplished by changing the boundary conditions of the waveguide cavity at the point of the coupling probes by varying the impedances of the loads connected to the probes. This changing of boundary conditions accomplishes a change in the wave propagation mode and thence mode conversion of the propagating microwave signal.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

What is claimed is:

1. A redundant microwave system operable to process a microwave signal propagating in a microwave cavity, comprising:

a microwave cavity;

a first microwave processing device located exterior to the microwave cavity, the first microwave processing device having a transmissive impedance when the first microwave processing device is operable and a reflective impedance when the first microwave processing device is not operable;

a first coupling probe extending from the first microwave processing device to a first probe termination location within an interior of the microwave cavity;

a second microwave processing device located exterior to the microwave cavity, the second microwave processing device being substantially identical to the first microwave processing device and having the transmissive impedance when the second microwave processing device is operable and the reflective impedance when the second microwave processing device is not operable; and a second coupling probe extending from the second microwave processing device to a second probe termination location within the interior of the microwave cavity.

2. The microwave system of claim 1, the first probe termination location and the second probe termination location are each positioned at about a respective one of the two electric field spatial maxima of a TE(2,0) microwave signal propagating in the waveguide.

3. The microwave system of claim 1, wherein the microwave cavity is a rectangular waveguide having a direction of elongation, a long transverse dimension perpendicular to the direction of elongation, a first sidewall parallel to the direction of elongation and perpendicular to the long transverse dimension, and a second sidewall parallel to the direction of elongation and perpendicular to the long transverse dimension, the first sidewall being spaced apart from the second sidewall by the long transverse dimension, and wherein the first probe termination location is about ¼ of the distance from the first sidewall to the second sidewall and the second probe termination location is about ¾ of the distance from the first sidewall to the second sidewall.

4. The microwave system of claim 1, wherein the microwave cavity is a rectangular waveguide having a direction of elongation, a long transverse dimension perpendicular to the direction of elongation, a first sidewall parallel to the direction of elongation and perpendicular to the long transverse dimension, and a second sidewall parallel to the direction of elongation and perpendicular to the long transverse dimension, the first sidewall being spaced apart from the second sidewall by the long transverse dimension, and wherein the first probe termination location and the second probe termination location are each about midway between the first sidewall and the second sidewall.

5. The microwave system of claim 1, wherein the microwave cavity comprises a first volume, a microwave feed in communication with the first volume, a second volume communicating with the first volume, the second volume being separated into a first region and a second region by a wall, and wherein the first probe termination location is within the first region and the second probe termination location is within the second region.

6. The microwave system of claim 1, wherein at least one of the first coupling probe and the second coupling probe is a coaxial probe.

7. The microwave system of claim 1, wherein at least one of the first coupling probe and the second coupling probe is a stripline probe.

8. The microwave system of claim 1, wherein the first microwave processing device is selected from the group consisting of an amplifier and a receiver.

9. The microwave system of claim 1, wherein at least one of the first microwave processing device and the second microwave processing device includes an impedance-matching network.

10. A redundant microwave system operable to process a microwave signal propagating in a microwave cavity, comprising:

a microwave cavity;

a first microwave processing device located exterior to the microwave cavity, the first microwave processing device having a transmissive impedance when the first microwave processing device is operable and a reflective impedance when the first microwave processing device is not operable;

a first coupling probe extending from the first microwave processing device to a first probe termination location within an interior of the microwave cavity;

a second microwave processing device located exterior to the microwave cavity, the second microwave processing device being substantially identical to the first microwave processing device and having the transmissive impedance when the second microwave processing device is operable and the reflective impedance when the second microwave processing device is not operable; and a second coupling probe extending from the second microwave processing device to a second probe termination location within the interior of the microwave cavity, wherein the first probe termination location and the second probe termination location are each positioned at about the electric field spatial maximum of a TE(0,1) microwave signal propagating in the waveguide.

11. A redundant microwave system operable to process a microwave signal propagating in a microwave cavity and having a propagation mode with at least one electric-field spatial maximum location, comprising:

a microwave waveguide;

a first microwave processing device located exterior to the waveguide;

a first coupling probe extending from the first microwave processing device into an interior of the waveguide at a first probe termination location substantially coincident with a first electric-field spatial maximum location;

a second microwave processing device located exterior to the waveguide, the second microwave processing device being substantially identical to the first microwave processing device;

a second coupling probe extending from the second microwave processing device into the interior of the waveguide at a second probe termination location substantially coincident with a second electric-field spatial maximum location, wherein the first electric-field spatial maximum location is the same as the second electric-field spatial maximum location if there is exactly one electric-field spatial maximum location, and wherein the first electric-field spatial maximum location is different than and spaced apart from the second electric-field spatial maximum location if there is more than one electric-field spatial maximum location.

12. The microwave system of claim 11, wherein there are two electric-field spatial maxima.

13. The microwave system of claim 11, wherein at least one of the first coupling probe and the second coupling probe is a coaxial probe.

14. The microwave system of claim 11, wherein at least one of the first coupling probe and the second coupling probe is a stripline probe.

15. The microwave system of claim 11, wherein the first microwave processing device is selected from the group consisting of an amplifier and a receiver.

16. A redundant microwave system operable to process a microwave signal propagating in a microwave cavity and having a propagation mode wherein there is one electric-field spatial maximum location, comprising:

a microwave waveguide;

a first microwave processing device located exterior to the waveguide;

a first coupling probe extending from the first microwave processing device into an interior of the waveguide at a first probe termination location substantially coincident with a first electric-field spatial maximum location;

a second microwave processing device located exterior to the waveguide, the second microwave processing device being substantially identical to the first microwave processing device;

a second coupling probe extending from the second microwave processing device into the interior of the waveguide at a second probe termination location substantially coincident with a second electric-field spatial maximum location, wherein the first electric-field spatial maximum location is the same as the second electric-field spatial maximum location if there is exactly one electric-field spatial maximum location, and wherein the first electric-field spatial maximum location is different than and spaced apart from the second electric-field spatial maximum location if there is more than one electric-field spatial maximum location.

17. A redundant microwave system operable to process a microwave signal propagating in a microwave cavity, comprising:

a microwave cavity comprising a first volume, a microwave feed in communication with the first volume, a second volume communicating with the first volume, and a wall separating the second volume into a first region and a second region;

a first microwave processing device located exterior to the microwave cavity, the first microwave processing device including an impedance matching network and having a transmissive impedance when the first microwave processing device is operable and a reflective impedance when the first microwave processing device is not operable;

a first coupling probe extending from the first microwave processing device to the first region of the microwave cavity;

a second microwave processing device located exterior to the microwave cavity, the second microwave processing device being substantially identical to the first microwave processing device; and a second coupling probe extending from the second microwave processing device to the second region of the microwave cavity.

18. The microwave system of claim 17, wherein at least one of the first coupling probe and the second coupling probe is a coaxial probe.

19. The microwave system of claim 17, wherein at least one of the first coupling probe and the second coupling probe is a stripline probe.

20. The microwave system of claim 17, wherein the first microwave processing device is selected from the group consisting of an amplifier and a receiver.

* * * * *